US007316117B2

(12) United States Patent
Ohri

(10) Patent No.: US 7,316,117 B2
(45) Date of Patent: Jan. 8, 2008

(54) CAN-ANNULAR TURBINE COMBUSTORS COMPRISING SWIRLER ASSEMBLY AND BASE PLATE ARRANGEMENTS, AND COMBINATIONS

(75) Inventor: Rajeev Ohri, Winter Springs, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 477 days.

(21) Appl. No.: 11/051,799

(22) Filed: Feb. 4, 2005

(65) Prior Publication Data

US 2006/0174625 A1 Aug. 10, 2006

(51) Int. Cl.
*F23R 3/60* (2006.01)

(52) U.S. Cl. ..... 60/796; 60/748

(58) Field of Classification Search ..... 60/39, 60/37, 725, 748, 796, 800
See application file for complete search history.

(56) References Cited

U.S. PATENT DOCUMENTS

| | | | | |
|---|---|---|---|---|
| 3,648,457 | A | | 3/1972 | Bobo |
| 3,703,259 | A | | 11/1972 | Sturgess et al. |
| 3,811,278 | A | | 5/1974 | Taylor et al. |
| 3,853,273 | A | | 12/1974 | Bahr et al. |
| 3,946,552 | A | | 3/1976 | Weinstein et al. |
| 4,584,834 | A | | 4/1986 | Koshoffer et al. |
| 4,653,278 | A | | 3/1987 | Vinson et al. |
| 4,726,192 | A | | 2/1988 | Willis et al. |
| 4,763,482 | A | | 8/1988 | Wehner |
| 5,310,337 | A | | 5/1994 | Lifshits et al. |
| 5,490,378 | A | | 2/1996 | Berger et al. |
| 5,675,971 | A | | 10/1997 | Angel et al. |
| 5,865,024 | A | | 2/1999 | Kress et al. |
| 6,026,645 | A | * | 2/2000 | Stokes et al. ..... 60/737 |
| 6,082,111 | A | * | 7/2000 | Stokes ..... 60/748 |
| 6,098,407 | A | | 8/2000 | Korzendorfer et al. |
| 6,164,058 | A | | 12/2000 | Dobbeling et al. |
| 6,279,323 | B1 | | 8/2001 | Monty et al. |
| 6,427,435 | B1 | | 8/2002 | Patterson et al. |
| 6,442,940 | B1 | | 9/2002 | Young et al. |
| 6,481,209 | B1 | | 11/2002 | Johnson et al. |
| 6,581,386 | B2 | | 6/2003 | Young et al. |
| 6,705,087 | B1 | | 3/2004 | Ohri et al. |
| 6,725,667 | B2 | | 4/2004 | Farmer et al. |
| 6,758,045 | B2 | | 7/2004 | Dimov et al. |
| 6,775,983 | B2 | | 8/2004 | Sanderson et al. |
| 6,779,268 | B1 | | 8/2004 | Farmer |
| 2002/0011064 | A1 | | 1/2002 | Crocker et al. |
| 2003/0010034 | A1 | | 1/2003 | Baudoin et al. |
| 2003/0131600 | A1 | | 7/2003 | David et al. |
| 2004/0065090 | A1 | | 4/2004 | Al-Roub et al. |
| 2004/0148938 | A1 | | 8/2004 | Mancini et al. |

* cited by examiner

*Primary Examiner*—L. J. Casaregola

(57) ABSTRACT

A gas turbine combustor (10) comprises a main swirler assembly (400) comprising an annulus casting (410) itself comprising a modified downstream end (418) fitted into an reversed-edge base plate (450) that comprises an opening (453) defined by a lip (452) oriented upstream. The lip (452) comprises an upstream surface (457), an outboard surface (458) and an inboard surface (459). In certain embodiments the modified downstream end (418) has a shape to fit against the upstream surface (457) and the outboard surface (458) so as to increase the natural frequency of the main swirler assembly (400) to above the natural frequency of the combustion in the gas turbine combustor (10).

18 Claims, 4 Drawing Sheets

CAN-ANNULAR TURBINE COMBUSTORS COMPRISING SWIRLER ASSEMBLY AND BASE PLATE ARRANGEMENTS, AND COMBINATIONS

FIELD OF THE INVENTION

This invention relates to a combustion products generator, such as a gas turbine, having a plurality of swirler-type fuel/air mixing apparatuses comprising sleeve-like annulus casting housings, each such apparatus respectively disposed to meet upstream-oriented surfaces of a modified base plate so as to increase the natural frequency of each apparatus, and to combinations and components thereof.

BACKGROUND OF THE INVENTION

Combustion engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustion section. The products of combustion are harnessed and directed through a turbine section, where they expand and turn a central rotor.

A variety of combustor designs exist, with different designs being selected for suitability with a given engine and to achieve desired performance characteristics. One popular combustor design, known as a can-annular type design, comprises in each of a plurality of arranged "cans" a centralized pilot burner (hereinafter referred to as a pilot burner or simply pilot) and a number of main fuel/air mixing apparatuses. The main fuel/air mixing apparatuses are arranged circumferentially around the pilot burner. With this design, a central pilot flame zone and a mixing region are formed. During operation, the pilot burner selectively produces a stable flame in the pilot flame zone, while the fuel/air mixing apparatuses each produce a mixed stream of fuel and air in the above-referenced mixing region. The stream of mixed fuel and air flows out of the mixing region, past the pilot flame zone, and into a main combustion zone, where additional combustion occurs. Energy released during combustion is captured by the downstream components to produce electricity or otherwise do work.

In order to ensure optimum performance of a common combustor, it is generally preferable that the respective fuel-and-air streams are well mixed to avoid localized, fuel-rich regions. As a result, efforts have been made to produce combustors with essentially uniform distributions of fuel and air. Swirler elements, for example, are often used to produce a stream of fuel and air in which air and injected fuel are evenly mixed.

Gas turbine technology has evolved toward greater efficiency and also to accommodate environmental standards in various nations. One aspect in the evolution of designs and operating criteria is the use of leaner gas air mixtures to provide for increased efficiency and decreased emissions of NOx and carbon monoxide. Combustion of over-rich pockets of fuel and air leads to high-temperature combustion that produces high levels of unwanted NOx emissions.

Also, a key objective in design and operation of gas turbine combustors is the stability of the flame and, related to that, the prevention of flashbacks. A flashback occurs when flame travels upstream from the combustion zone in the combustion chamber and approaches, contacts, and/or attaches to, an upstream component. Although a stable but lean mixture is desired for fuel efficiency and for environmentally acceptable emissions, a flashback may occur at times more frequently with a lean mixture, and particularly during unstable operation. For instance, the flame in the combustion chamber may progress backwards and rest upon, for a period, a base plate which defines the upstream end of the combustion chamber. Less frequently, the flame may flash back into a fuel/air mixing apparatus, damaging components that mix the fuel with the air.

A multitude of factors and operating conditions provide for efficient and clean operation of the gas turbine combustor area during ongoing operation. Not only is the fuel/air mixture important. Also relevant to gas turbine operation are the shape of the combustion area, the arrangement of assemblies that provide fuel, and the length of the combustor that provides varying degrees of mixing. Given the efficiency and emissions criteria, the operation of gas turbines requires a balancing of design and operational approaches to maintain efficiency, meet emission standards, and avoid damage due to undesired flashback occurrences.

Also relevant to design and operation of gas turbine combustors is the avoidance of breakage of components, such as due to stress from vibration and cyclic stress, such as may come from having a first fundamental mode (i.e., a first natural frequency) within the range of the combustion dynamics.

The type of fuel/air mixing apparatus, and how it operates in relationship to other components, is one of the key factors in proper operation of current gas turbines. A common type of fuel/air mixing apparatus is known as a main swirler assembly. A main swirler assembly is comprised in part of a substantially hollow inner body that comprises stationary flow conditioning members (such as vanes) that create a turbulent flow. Fuel from a fuel nozzle is added before or into this turbulent air stream and mixes to a desired degree within a period of time and space so that it is well-mixed upon combustion in the downstream combustion chamber. Also, in typical arrangements, a main swirler assembly also is comprised of an outer downstream element known as an annulus casting. An annulus casting (referred to in some references as a "sleeve") surrounds a downstream section of the inner body, forming a channel for air flow known as the flashback annulus. In a typical arrangement, a quantity, such as eight, swirler assemblies are arranged circumferentially around the central pilot burner. The pilot burner burns a relatively richer mixture than is provided by the radially arranged swirler assemblies. In a typical arrangement of a can-annular design of a gas turbine, 16 combustor cans, each having eight main swirler assemblies disposed around a central pilot burner, are arranged annularly and collectively provide combusted gases to a turbine.

As shown in FIG. 1, an example of a prior art gas turbine combustor 10 comprises a nozzle housing 12 having a nozzle housing base 14. A diffusion fuel pilot nozzle 16, having a pilot fuel injection port 18, extends through nozzle housing 12 and is attached to nozzle housing base 14. In the shown configuration, main fuel nozzles 20, each having at least one main fuel injection port 22, extend substantially parallel to pilot nozzle 16 through nozzle housing 12 and are attached to nozzle housing base 14. Fuel inlets 24 provide fuel 26 to main fuel nozzles 20. A main combustion zone 28 is formed within a liner 30 peripheral and downstream to a pilot flame zone 38. A pilot cone 32, having a diverged end 34, projects from the vicinity of pilot fuel injection port 18 of pilot nozzle 16. Diverged end 34 is downstream of main swirler assemblies 36. The pilot flame zone 38 is formed within pilot cone 32 adjacent to and upstream to main combustion zone 28.

Compressed air 40 from compressor 42 flows between support ribs 44 through main swirler assemblies 36. Each main swirler assembly 36 is substantially parallel to pilot nozzle 16 and adjacent to main combustion zone 28. Within each main swirler assembly 36, a plurality of swirler vanes 46 generate air turbulence upstream of main fuel injection ports 22 to mix compressed air 40 with fuel 26 to form a fuel/air mixture 48. Fuel/air mixture 48 is carried into main combustion zone 28 where it combusts. Compressed air 50 enters pilot flame zone 38 through a set of stationary turning vanes 52 located inside pilot swirler 54. Compressed air 50 mixes with pilot fuel 56 within pilot cone 32 and is carried into pilot flame zone 38 where it combusts.

FIG. 2 shows a detailed view of an exemplary prior art main swirler assembly 36. As shown in FIG. 2, main swirler assembly 36 is substantially cylindrical in shape, having a flared inlet end 58 and a tapered outlet end 60. A plurality of swirler vanes 46 are disposed circumferentially around the inner perimeter 62 of fuel swirler 36 proximate flared end 58. In the shown configuration, main swirler assembly 36 surrounds main fuel nozzle 20 proximate main fuel injection ports 22. Main swirler assembly 36 is positioned with swirler vanes 46 upstream of main fuel injection ports 22 and tapered end 60 adjacent to main combustion zone 28. Flared inlet end 58 is adapted to receive compressed air 40 and channel it into fuel swirler 36. Tapered outlet end 60 is adapted to fit into annulus casting 64 by weld connection, forming a channel known as a flashback annulus 65 through which air passes. Swirler vanes 46 are attached to a hub 66. Hub 66 surrounds main fuel nozzle 20.

FIG. 3 shows an upstream view of combustor 10. Pilot nozzle 16 is surrounded by pilot swirler 54. Pilot swirler 54 has a plurality of stationary turning vanes 52. Pilot nozzle 16 is surrounded by a plurality of main fuel nozzles 20. A main swirler assembly 36 surrounds each main fuel nozzle 20. Each main swirler assembly 36 has a plurality of swirler vanes 46. The diverged end 34 of pilot cone 32 forms an annulus 68 with liner 30. Main fuel swirlers 36 are upstream of diverged end 34. A fuel/air mixture flows through annulus 68 (out of the page) into main combustion zone 28 (not shown in FIG. 3).

As viewable in FIG. 2, main swirler assembly 36 is attached to liner 30 via attachments 70 and a conventional base plate 72. With respect to the latter manner of attachment, the distal end of annulus casting 64 is adjacent to the conventional base plate 72 as shown in FIG. 2. The conventional base plate 72 has a plurality of openings (such as 77 in FIG. 2) that are defined by downstream-oriented lips (such as 76 in FIG. 2). The distal end of annulus casting 64 and the downstream-oriented lip 76 of the conventional base plate 72 typically do not come into contact and are actually spaced up to approximately 10 mils (0.010 inches) apart in prior art embodiments. FIG. 3 shows a circular array of six swirlers, but other quantities, such as a series of eight swirlers, can be employed.

The other manner of attaching the main swirler assembly 36 to liner 30 is by way of attachments 70. In some prior art designs, attachments 70 comprised dual straight pins, each pin being welded at one end to liner 30 and at the other end to the main swirler assembly 36 as shown in FIG. 2. In other designs, hourglass-shaped pins (as shown in FIG. 4) provided larger weld areas on both the main swirler assembly 36 and the liner 30. Under certain operating conditions, both types of designs were observed to have fatigue-related failures. This led to consideration that the problem of such failures was related to the main swirler assemblies having a natural frequency within the range of the natural frequency of the combustion events in the combustor, and to the solution of this identified problem as disclosed herein.

More particularly, without being held to a particular theory, it is believed that some fatigue failures stem from a swirler's exposure to vibrational forces generated during combustor operation. Dominant combustion dynamics typically range from approximately 110-150 Hz, although variations outside this range are possible depending on the system design. The main swirler assembling in prior art swirler/base plate arrangements, when adjacent to the base plate, generally has a first fundamental mode (i.e., a natural frequency) of approximately 145 Hz, falling within the typical vibrational range of such combustion dynamics. Consequently, when a swirler is subjected to such forces, the swirler will resonate, and, it is believed, repeated resonance of the swirler ultimately fatigues the weld joints of the support pins.

Thus, high cycle fatigue failures are believed to be a recurring problem with respect to swirlers and other turbo machinery components. The problem has been exacerbated by combustion design changes to reduce emissions and increase efficiency. These design changes have increased the severity of the combustion dynamics, requiring more robust swirler assemblies. Therefore, there is a continuing need for a swirler assembly that can avoid vibration-induced resonance, that can further enhance the inherent damping characteristics of the main swirler to constrain any vibratory motion, and further that has a design that reduces or eliminates the occurrence of flashback.

Various approaches to reduce or eliminate flashback in modern gas turbine combustion systems have been attempted. Since the prevention or elimination of flashbacks is a multi-factorial issue and also relates to various aspects of the design and operation of the gas turbine combustion area, a range of approaches has been attempted. These approaches often inter-relate with one another.

One example of approaches to reach a balance among the needs to reduce flashbacks, maintain reasonable initial costs, maintain operating efficiency, and reduce downtime and costs due to component failure is provided in U.S. Pat. No. 6,705,087. This and all other patents, patent applications, patent publications, and other publications referenced herein are hereby incorporated by reference in this application in order to more fully describe the state of the art to which the present invention pertains, and to provide such teachings as are generally known to those skilled in the art.

The inventor of the present invention has appreciated the importance considering the durability criterion along with reduction of flashback. As a solution to the problem of balancing these criteria, a solution in the form of the present invention was attained. More particularly, the present invention provides a solution toward obtaining an operationally stable, flashback-resistant main fuel/air mixing apparatus, such as a swirler assembly, that is structurally stable and has an elevated natural frequency outside the range of the normal dominant combustion dynamics frequency.

BRIEF DESCRIPTION OF THE DRAWINGS

The foregoing and other features of the invention will be apparent from the following more particular description of the invention, as illustrated in the accompanying drawings.

DETAILED DESCRIPTION OF THE INVENTION

It is appreciated that design of turbo components and systems requires a balancing of performance, effluent, and longevity criteria. The present invention is adapted to tolerate the severity of the dynamics of combustors designed for reduced emissions and greater efficiencies. The present invention provides a more vibrationally tolerant swirler assembly and a method for making such a swirler assembly and swirler assembly/base plate combination that have a natural frequency outside of the range of combustion-generated vibrational forces to prevent swirler resonance. As used herein, including the claims, the term "natural frequency" is taken to mean the first fundamental mode (i.e., a first natural frequency).

In addition, the swirler assembly and swirler assembly/base plate combinations according to aspects of the invention enhances the vibration damping capability of the swirler assembly so as to subdue any vibrational forces acting on the overall combustor system. The occurrence of flashback also is reduced or eliminated. The invention has application to various turbo machinery components. Features of the invention are, however, described with respect to fuel swirler assemblies for use in a turbine combustor.

The present invention relates to an arrangement of gas turbine combustor components that provides for axial movement of and an increased natural frequency of a swirler assembly. In particular embodiments a design for and fit between the downstream end of a swirler assembly annulus casting and an upstream oriented end of a base plate provides for axial movement of the swirler assembly during thermal and vibrational fluctuations, while also providing an increased natural frequency for the swirler assembly, and comprising a design adapted to reduce or eliminate the occurrence of flashback. Embodiments of the present invention provide for designs that result in an increase in the natural frequency of a swirler assembly concomitant with an enhanced damping of vibrations received by the swirler assembly, such as from the combustion dynamics. This provides for a low to very low vibration transmissibility. For example, transmissibility may be defined as ½Q, where Q is damping (i.e., input divided by output of a vibration). For some embodiments of the present invention, there is a fit effective to elevate the natural frequency of a main swirler assembly above 700 cycles per second that concomitantly is effective to provide a transmissibility below about 10.

Figure 4:
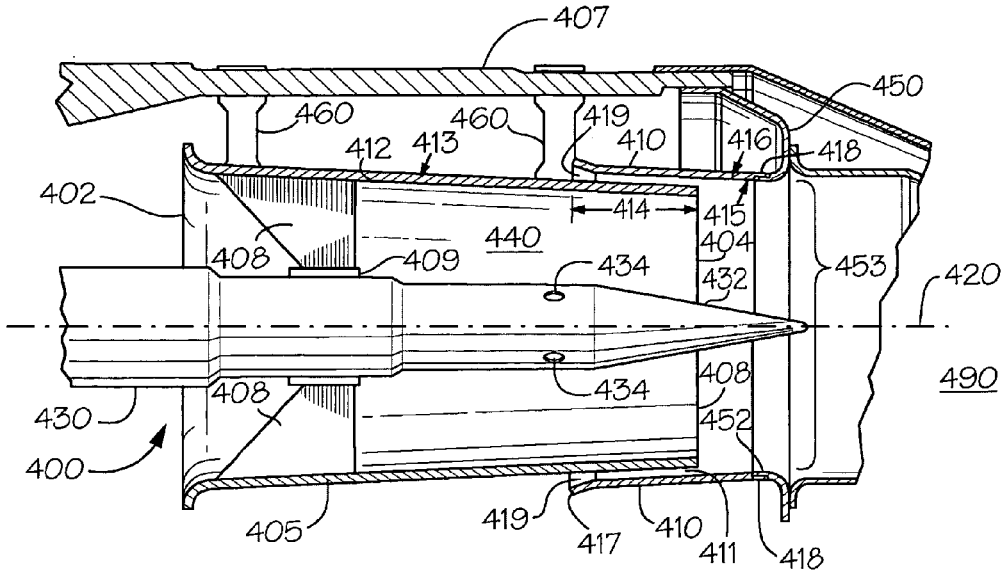
FIG. 4 is a cross-sectional view one embodiment of a swirler assembly meeting a base plate according to the present invention.

FIG. 4 provides a side cross-sectional view one embodiment of a swirler assembly meeting a base plate according to the present invention. In FIG. 4, an exemplary main swirler assembly 400 is shown. The swirler is not limited to any particular configuration, but its inner body 405 will generally have a front end 402 and an exhaust end 404. The main swirler assembly 400 of FIG. 4 is generally cylindrical in shape, but a main swirler assembly of the present invention may be any shape, such as rectangular or polygonal, as dictated by design considerations and performance requirements. Also, in the shown embodiment, the swirler assembly tapers from the flared inlet front end 402 to the exhaust end 404. Like the other features of the swirler assembly, the outer surface does not have to be tapered. For example, a swirler assembly of the present invention may have a generally uniform cross-sectional profile along its length.

Figure 1:
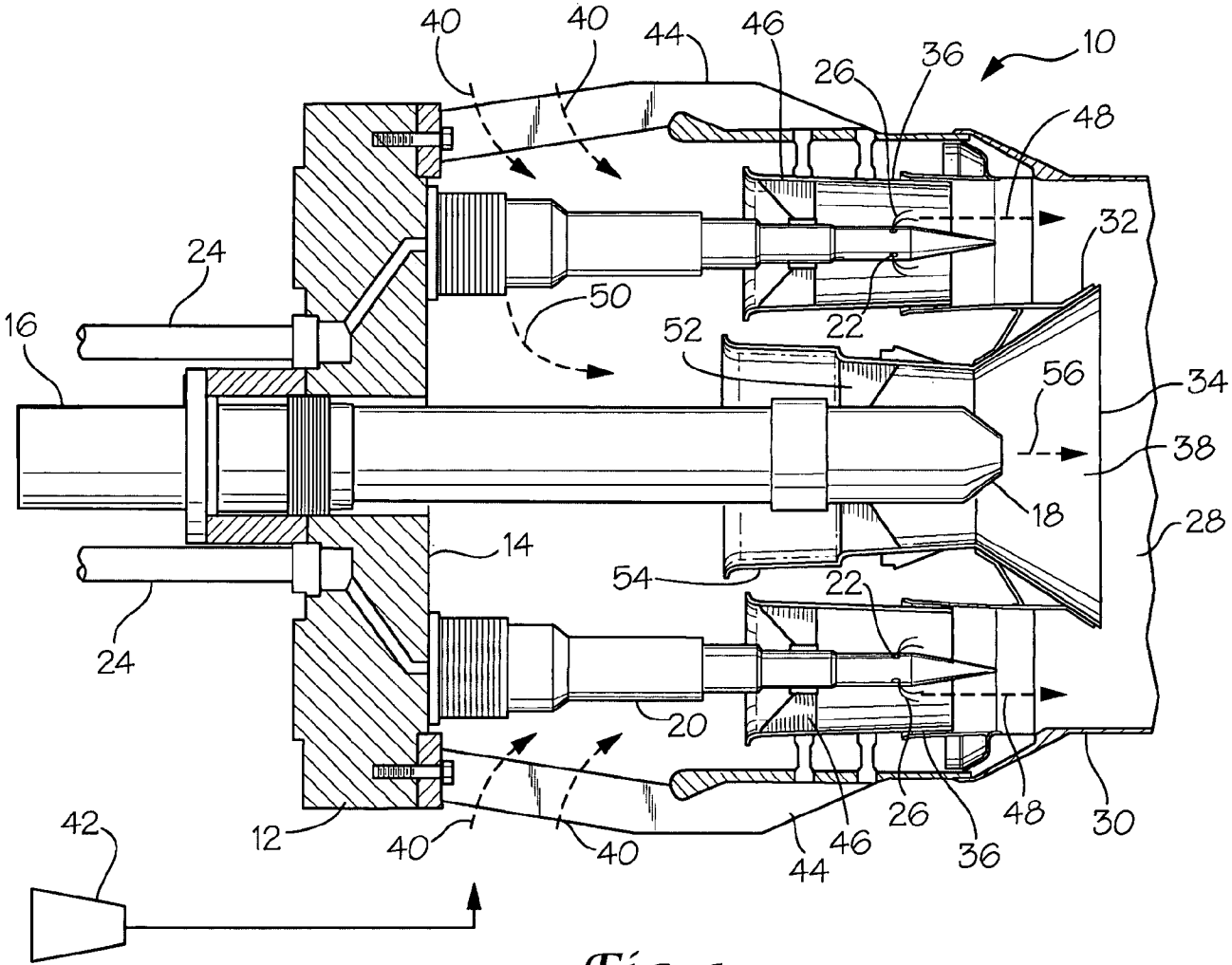
Fig. 1 (PRIOR ART)
FIG. 1 is a cross-sectional view of a prior art gas turbine combustor.

The main swirler assembly 400 comprises the inner body 405 and an annulus casting 410 forming there between a flashback annulus 411, both of which structures as depicted are generally cylindrical. The direction of air flow during operation is indicated by an arrow. At the front end 402 of main swirler assembly inner body 405 are viewable swirler flow conditioning members 408 (common forms of which are referred to as vanes in the art) which impart turbulence upon the air flowing through the main swirler assembly inner body 405. An axis 420 for air flow is defined by a linear path between an front end 402 disposed upstream and the exhaust end 404 disposed downstream, and typically the swirler flow conditioning members 408 are disposed angularly relative to this axis so as to create turbulence upon the air flowing through the swirler assembly inner body. Fuel is supplied by way of a fuel delivery member 430 comprising a fuel supply passage (not shown) and a rocket-shaped end 432 (noting, however that embodiments of the fuel delivery member are referred to by some in the art as a "rocket" in its entirety). The fuel supply passage is in fluid communication with a plurality of fuel exit ports 434 through which the fuel flows and is thereby dispersed into the flowing air through. The turbulence imparted by the flow conditioning members 408 provides for mixing of fuel and air in the hollow passage, or bore, 440 of the main swirler assembly inner body 405. The rod-like fuel delivery member 430 typically also provides some structural support, being attached to structural elements of a burner assembly (not shown in FIG. 4, see FIG. 1), and in sliding engagement with a hub 409 to which are affixed the plurality of flow conditioning members 408. Also, as shown in FIG. 4, the main swirler assembly 400 is attached and stabilized by two pins 460, which can be welded to the main swirler assembly 400 at one end and welded or otherwise secured to the combustor outer liner 401. The pins 460 can be hour-glass shaped in profile to provide expanded welding footprints, or any other shape as is known in the art. Any number of pins may be used for attachment of a main swirler assembly to a liner. (Also, in some embodiments (not shown) an attachment connects from the annulus casting 410 to the liner 401.)

While not meant to be limiting, in some embodiments of a main swirler assembly the inner body comprises a main swirler assembly casing having an upstream front end and a downstream exhaust end and a plurality of swirler flow conditioning members arranged within a bore defined by the casing, and a downstream section of the casing is in substantially concentric cylindrical alignment within the annulus casting to define a flashback annulus.

As depicted in FIG. 4, a substantially cylindrical casing 412 having an outer surface 413 surrounds and defines the bore 440 of the inner body 405. The flashback annulus 411 is the channel formed between a downstream section 414 of the casing 412 and the annulus casting 410. Each annulus casting 410 has an inner surface 415, an outer surface 416, an upstream end 417, a downstream end 418. The use of the term "casting" in "annulus casting" is a term of art and is not meant to limit the method of fabrication of the annulus casting. For instance, an annulus casting may be fabricated by casting, by forging, by welded assembly, or by other methods known in the art.

Typically, tabs 419 or other spacing structures (not shown) are positioned between and contact both the outer surface 413 of the casing 412 and the inner surface 415 of the annulus casting 410 at points within the flashback annulus 411. Such spacing structures establish a width of the flashback annulus and provide structural support during operation by passing load from one component to the other. Notwithstanding these spacing structures, which occupy a small percentage of the volume of the flashback annulus 411, the airflow produced in the flashback annulus 411 assumes and retains for a certain distance downstream a generally hollowed cylindrical shape (i.e., a hollow column when the flashback annulus 411 is circular) corresponding to the annular cross-sectional shape of the flashback annulus 411. As this air column encounters objects, such as the pilot shroud, and other air currents, it is subject to deformation from its original shape.

During operation of the combustor, the central pilot provides a constant flame, albeit often of a richer fuel/air mixture to assure its continuity. Each of the swirler assemblies emits a fuel/air mixture that enters the combustion chamber and becomes ignited. As the fuel/air ratio of the fuel/air mixture from these swirler assemblies is made leaner, which is done for efficiency and/or to meet environmental standards for emissions, the combustion system tends to become less stable. Under such conditions, and based on a number of variables including combustion dynamics that typically are in flux, a flashback of the flame to the base plate may occur. Over time, repeated occurrence of flashbacks to the base plate, or less frequently to components within the main swirler assembly inner body, may damage the base plate, main swirlers, combustor liner and other components as these are not designed for repeated direct exposure to flame temperature.

As inferable from the nomenclature, a major purpose of the air flowing through the flashback annulus 411 is to discourage flashback occurrence. Without being bound to a particular theory, the basis for this is that a column of air released from the flashback annulus 411 serves as a barrier, for a distance, to prevent the flames in the combustor from 1) contacting the fuel/air mixture within it (from the respective main swirler assembly inner body) until that fuel/air mixture is sufficiently downstream in the combustor chamber and/or 2) moving backwards (i.e., upstream, toward the base plate, described below) either exteriorly of the normal path of the main fuel/air flows from the swirler assemblies or interiorly, between the pilot flame and the swirler assemblies.

In addition to the structural support provided by pins such as 460 and via the fuel delivery member such as 430, a main swirler assembly generally also is supported by attachment to or in contact with a base plate at its downstream end. A base plate generally comprises a outer circumferential section meeting the combustor liner and an opening for each of a plurality of main swirler assemblies, where the lip of each such opening is oriented downstream. In contrast to conventional designs of a base plate as known in the art, the present invention utilizes an opening in the base plate to receive each main swirler assembly wherein the base plate opening comprises an upstream-oriented lip that receives an adapted downstream end of a main swirler assembly. This is referred to herein as a reversed-edged base plate (comprising a reversed-lipped base plate opening).

Figure 2:
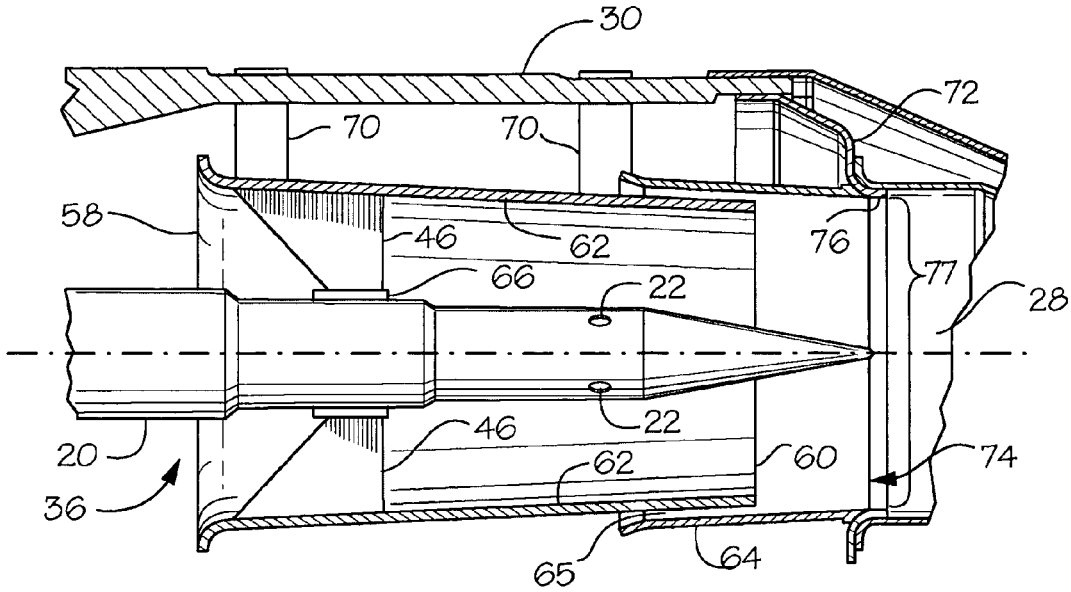
Fig. 2 (PRIOR ART)
FIG. 2 is a cross-sectional view of a prior art main fuel swirler.
Figure 3:
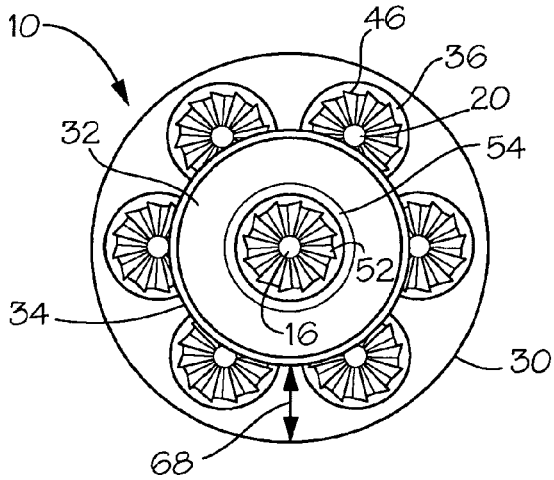
Fig. 3 (PRIOR ART)
FIG. 3 is an upstream view of a prior art gas turbine combustor.

FIG. 4 shows a general view of an arrangement of a main swirler assembly 400 and a reversed-edged base plate 450. In contrast to the downstream-oriented lip 76 of the opening 77 for a main swirler assembly as identified and depicted in FIG. 2, a lip 452 defining an opening 453 of the reversed-edged base plate 450 in FIG. 4 is directed upstream and is designed to contact a modified downstream end 418 of the annulus casting 410.

Figure 5A:
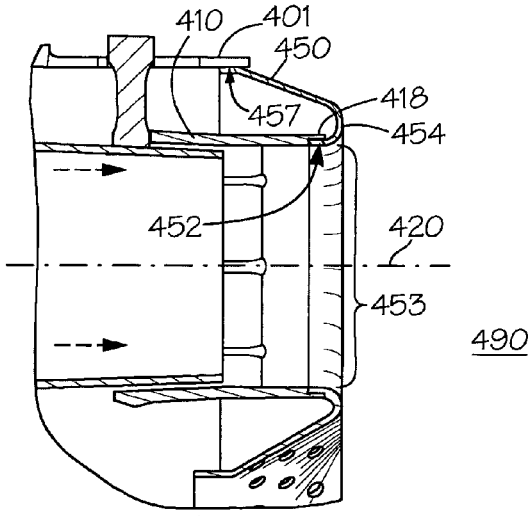
FIGS. 5A and 5B are close-up views of FIG. 4 at two levels of enlargement, providing more details of the design of and the relationship between a reversed-edged base plate and a modified downstream end of the annulus casting of the present invention.
Figure 5B:
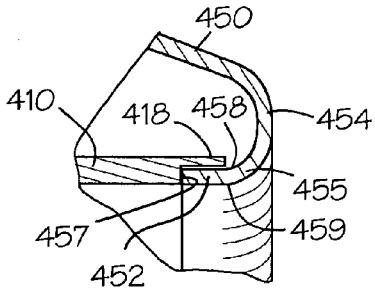

FIGS. 5A and 5B provide close-up views of FIG. 4 at two levels of enlargement, providing more details of the design of and the relationship between the reversed-edged base plate 450 and the modified downstream end 418 of the annulus casting 410 of the present invention. FIG. 5A shows a cut-off, cut-away side view of a downstream portion of the main swirler assembly 400 of FIG. 4, and FIG. 5B shows the detail of the encircled structure in FIG. 5A. Generally, the overall structure of the base plate 450 supports a plurality of main swirler assemblies 400 and attaches each main swirler assembly 400 to the outer liner 401. Commonly, the base plate 450 is made of an alloy, for example, Hastelloy X. The base plate 450 is generally disposed between the main swirler assemblies 400 and the combustion chamber 490. (It is noted that the shape and structure of the combustion chamber 490 may be of any known to those skilled in the art.)

The base plate 450 can be anchored to the outer liner 401 by welds (not shown) along a base plate outer edge 451. The base plate 450 may be a single component such as a flat plate, or it may be a localized area of a larger structure. Moving centrally from the attachment of the base plate 450 with the outer liner 401 the base plate 450 angles inward and downstream, then downward to a plane substantially transverse to the axis 420, to form a generally transverse face 454. Then the base plate 450 curves upstream ending in the upstream disposed lip 452. The opening 453 as defined by the lip 452 is circular when meeting a circular downstream end 418 of the annulus casting 410. As used in this specification, under such circumstances the lip 452 may be referred to as annular to describe the generally ring-like shape of the surface. However, it is appreciated that other shapes may be utilized to conform to alternative shapes of a downstream end of an annulus casting, or other structure substituting for this.

Thus, as shown in FIG. 5 the base plate opening 453 is defined by a ring-like, or annular, lip 452 that is oriented in the upstream direction. This lip 452 has an upstream surface 457, an outboard surface 458, and an inboard surface 459. The downstream end 418 of the annulus casting 410 is machined to meet the upstream surface 457 and at least a portion of the outboard surface 458. In certain embodiments of the present invention, this meeting is a tight fit, which is defined as providing a tolerance between 0 and 3 thousandths of an inch. This provides for axial movement during thermal expansion yet also provides for a desired elevation of the natural frequency of the main swirler assembly 400.

The overlapping junction between the downstream end 418 of the annulus casting 410 and the lip 452 is not meant to be limiting. Any other type of junction for engagement of these components may be used so long as it is effective to increase the natural frequency of the main swirler assembly of which the annulus casting (or analogous component) is a part.

Figure 6A:
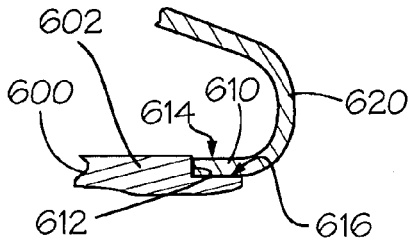
FIGS. 6A and 6B are close-up views providing details of alternative embodiments of the design of and the relationship between a reversed-edged base plate and a modified downstream end of the annulus casting of the present invention FIG. 7 provides an enlarged view of portion of the base plate, depicting a high-flashback-occurrence zone around one opening for a main swirler assembly.

For example, without being limiting, one type of an alternative embodiment comprises an engaging fit that includes a portion of the downstream end of the annulus casting disposed along the inboard surface of the lip of the base plate. FIG. 6A provides a side view of a portion of the fit between a downstream end 602 of an annulus casting 600 and a lip 610 of a base plate 620. Similar to the lip 452 in FIG. 5A, the lip 610 in FIG. 6A comprises an upstream surface 612, an outboard surface 614 and an inboard surface 616. Here, the downstream end 602 of the annulus casting 600 is machined to meet the upstream surface 612 and at least a portion of the inboard surface 616. In certain embodiments of the present invention, this meeting is a tight fit, which is defined as providing a tolerance between 0 and 3 thousandths of an inch. This provides for axial movement during thermal expansion yet also provides for a desired elevation of the natural frequency of the main swirler assembly (not shown in entirety in FIG. 6A).

Figure 6B:
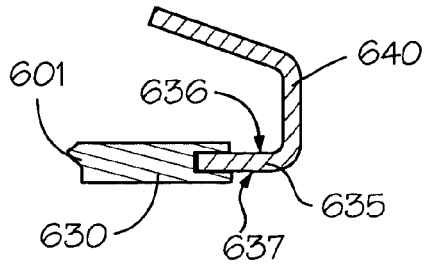

FIG. 6B provides another example of an alternative embodiment that comprises a fit that includes a portion of the downstream end of the annulus casting disposed along the inboard surface of the lip of the base plate. FIG. 6B provides a side view of a portion of the fit between a downstream end 630 of an annulus casting 601 and a lip 635 of a base plate 640. Here, however, the end 630 is machined so it fits along a portion of an outboard surface 636 and along a portion of an inboard surface 637 of the lip 635. In certain embodiments of the present invention, this meeting is a tight fit, which is defined as providing a tolerance between 0 and 3 thousandths of an inch. This provides for axial movement during thermal expansion yet also provides for a desired elevation of the natural frequency of the main swirler assembly (not shown in entirety in FIG. 6B). Also, it is noted that while the depictions herein provide distinct 90-degree edges between the respective surfaces of the upstream-oriented lip of the base plate, this is not meant to be limiting. For example, other shapes include shapes that have a curved, or curvilinear, transition from the inboard to the upstream to the outboard surfaces of the lip. Such other shapes are within the scope of the present invention.

It is further appreciated that the present invention may be effectuated with designs and arrangements of components that differ from those described and depicted above. As but one example, a multi-part casing, rather than the unitary casing depicted in the figures, may be used to house a set of swirler vanes mounted on a rod-like fuel delivery member. Alternatively, a unitary or a multi-part casing may be positioned to encompass the vanes but not contact them. Such casing is in operational orientation with a surrounding annulus casting to form an extended flashback annulus, in accordance with the above descriptions and definitions. It is noted that a shroud is one type of casing, and variations of the shroud component, such as are described in and U.S. patent application Ser. No. 10/984,526, filed Nov. 9, 2004, and entitled "An Extended Flashback Annulus" and that application is specifically incorporated by reference for the disclosures of shrouds and their variations.

Other examples include where the fuel is not supplied from orifices in the vanes of a main swirler assembly inner body, but are instead dispersed into the air flow from orifices upstream of the main swirler assembly inner body, by pegs within the bore of the main swirler assembly inner body, or from orifices (i.e., nozzles) positioned further downstream of the flow conditioning members, such as along the end, rocket section of the rod. Accordingly, the present invention is not limited to the particular embodiments and design and arrangement of components described herein. For example, embodiments of the present invention include embodiments of swirler assembly inner bodies that lack fuel delivery members as described herein.

Also, other approaches may be utilized to increase the robustness and effectiveness of the air barrier or column that is provided through the flashback annulus. As one example, the length of the main swirler assembly casing may be extended toward or beyond the downstream end of the flashback annulus, such as is described in and U.S. patent application Ser. No. 10/984,526, filed Nov. 9, 2004, and entitled "An Extended Flashback Annulus". That application is specifically incorporated by reference for the disclosures of such extension and other variations of the swirler assembly including the flashback annulus for reduction of flashback, to the extent those disclosures are consistent with the present invention. As another example, the gap, or space between the outside surface of the swirler assembly casing and the inside surface of the annulus casting, is about 1.2 millimeters in certain prior art apparatuses. This gap may be widened to provide for additional air flow to form a more robust, more effective protective cylindrical air barrier. One way to widen this gap is to fabricate a swirler assembly shroud with a relatively smaller diameter, thereby leaving more space between it and the annulus casting. Another way is to provide a redesigned annulus casting with a larger inside diameter. These two approaches also may be effectuated in combination with one another. In making such changes, the upstream supply and its distribution are attended to in order to assure that sufficient air flow and pressure are available for entry into the flashback annulus, so that widening the flashback annulus does not merely result in a weaker protective cylindrical air barrier. Also, a wider flashback annulus may, in some embodiments, result in a design that permits a relatively shorter length of the flashback annulus. Embodiments of extended and/or protected flashback annuluses that employ such approaches are considered within the scope of the present invention.

Figure 7:
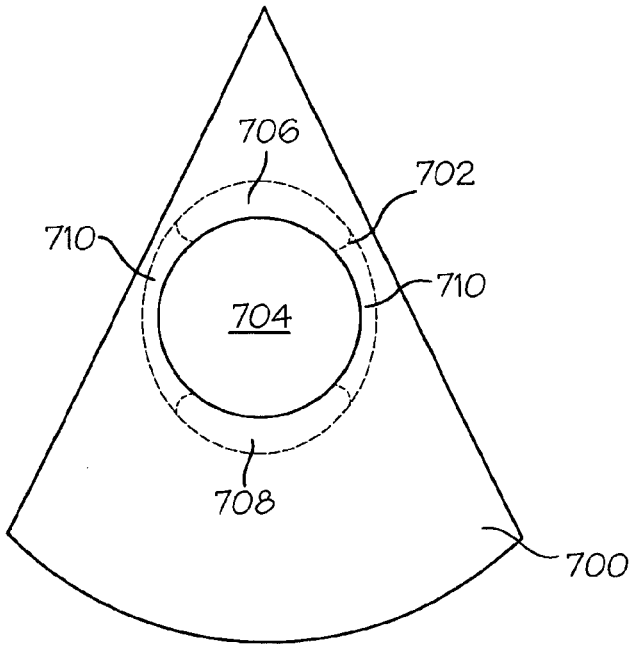

Without being bound to a particular theory, some embodiments of the present invention are effective to reduce the frequency of flashbacks, the sizes of zones of high flashback occurrence, and/or flashback-related structural damage. For example, FIG. 7 provides an enlarged view of portion of the base plate 700 depicting a high-flashback-occurrence zone 702 around a base plate opening 704 for a main swirler assembly (however, not depicting ventilation holes). This zone 702 is that part of base plate 700 between the large dashed lines and opening 704. This zone 702 is considered to comprise a part of the base plate 700 that receives a substantially high and disproportionate amount and/or severity of flashbacks based on observations of base plates that have been in gas turbines under routine operation. In such circumstances this zone 702 has been observed to have discoloration and, at times, cracks and other signs of structural damage attributed to flashback occurrence (not shown in FIG. 7). More particularly, and based on these indicia of flashback occurrence, it has been observed that an inboard area 706 and an outboard area 708 of the zone 702 (demarcated by the small dashed lines) experience relatively higher amounts and/or severity of flashbacks than the side areas 710 of zone 702. Thus, it has been observed that structural damage occurs more frequently in inboard area 706 and in outboard area 708 compared to side areas 710. Accordingly, regions in which such structural damage is found (not shown in FIG. 7) exist within areas 706 and 708, and less frequently in side areas 710. Without being bound to a particular theory, these regions of structural damage are believed due to one or both of: a) an increased number of flashbacks impinging on or near such a region; b) structural weakness of such a region, such as may be due to thermal stress and/or other factors. To the extent that flow dynamics are modified in various embodiments of the present invention to reduce flashbacks in these areas, these embodiments are effective to reduce the frequency of flashbacks and/or the total area of these regions of structural damage.

With regard to the occurrence of flashbacks in swirler assembly/base plate configurations of the present invention, it is appreciated that, compared to prior art arrangements, some embodiments of the present invention provide larger inner diameters of the flashback annulus at its downstream end. For example, comparing FIGS. 2 and 4, the downstream end of annulus casting 410 in FIG. 4 is more upstream, and accordingly (due to the frustroconical shape of the annulus casting 410), has a wider terminal diameter, than the downstream end of annulus casting 64 of FIG. 2. Given the flow dynamics during operation, this increase in inner diameter eliminates or reduces flashback. An increase in diameter of the downstream end of the annulus casting or other terminal component of a swirler assembly generally is observed to improve the flow dynamics so as to reduce or eliminate the occurrence of flashback. A modification to increase such diameter may be effectuated by a number of approaches, including, but not limited to, fabricating a wider annulus casting, providing a larger gap between the outside downstream surface of the swirler body casing and the inside surface of the annulus casting (thereby increasing the width of the flashback annulus), and, optionally, combining one or both of these with the reversed base plate design feature. A desired result of such modifications is to reduce or eliminate the occurrence of flashbacks under a range of operating conditions.

Further, it is appreciated that the disclosure herein also describes a base plate having one or more upstream-oriented lips for engaging one or more swirler assemblies. That is, an upstream-oriented base plate as disclosed herein is considered, by itself, one aspect of the present invention.

It should be understood that the examples and embodiments described herein are for illustrative purposes only and that various modifications or changes in light thereof will be suggested to persons skilled in the art and are to be included within the spirit and purview of this application and the scope of the appended claims.

I claim as my invention:

1. A gas turbine can-annular combustor comprising:

a. a main swirler assembly comprising an annulus casting having an upstream end and a downstream end, and b. a reversed-edged base plate comprising at least one opening defined peripherally by an upstream-oriented lip comprising an upstream surface, an outboard surface and an inboard surface;

the annulus casting downstream end contoured to engage the upstream-oriented lip.

2. The combustor of claim 1, providing a fit between the downstream end and the lip effective to increase a natural frequency of the main swirler assembly during gas turbine operation beyond combustion acoustics natural frequencies.

3. The combustor of claim 2, the fit being a tight fit having a tolerance between about 0 and 0.003 inch.

4. The combustor of claim 1, the annulus casting downstream end contoured to engage the lip along the upstream surface and at least a portion of the outboard surface of the lip.

5. The combustor of claim 4, a fit between the downstream end and the lip effective to elevate the natural frequency of the main swirler assembly above 700 cycles per second.

6. The combustor of claim 1, the annulus casting downstream end contoured to engage the lip along the upstream surface and at least a portion of the inboard surface of the lip.

7. The combustor of claim 6, a fit between the downstream end and the lip effective to elevate the natural frequency of the main swirler assembly above 700 cycles per second.

8. The combustor of claim 3, the fit additionally effective to reduce or eliminate resonance-based cracking of the main swirler assembly.

9. The combustor of claim 8, the annulus casting downstream end additionally comprising a diameter enlarged relative to an annulus casting downstream end corresponding to a conventional base plate, the enlarged diameter effective to reduce or eliminate flashback during operation.

10. The combustor of claim 5, wherein the transmissibility of vibration through the main swirler assembly remains below about 10.

11. The combustor of claim 7, wherein the transmissibility of vibration through the main swirler assembly remains below about 10.

12. The combustor of claim 1, wherein a plurality of main swirler assemblies are arranged in the combustor, each comprising a respective annulus casting having an upstream end and a downstream end, each downstream end of each respective annulus casting contoured to engage a respective one of a plurality of upstream-oriented lips of the reversed-edged base plate providing a fit effective to increase a natural frequency of the respective main swirler assembly during gas turbine operation beyond combustion acoustics natural frequencies.

13. A main swirler assembly/base plate combination for a gas turbine combustor, comprising:

a. a main swirler assembly comprising an annulus casting having an upstream end and a downstream end, and b. a reversed-edged base plate comprising an opening defined peripherally by an upstream-oriented lip comprising an upstream surface, an outboard surface and an inboard surface;

wherein the annulus casting downstream end is contoured to engage the upstream-oriented lip of the opening.

14. The combination of claim 13, providing a fit between the downstream end and the lip effective to increase a natural frequency of the main swirler assembly during gas turbine combustor operation beyond combustion acoustics natural frequencies.

15. The combination of claim 14, the fit additionally effective to enhance vibration damping compared to fit between a conventional base plate and a corresponding main swirler assembly.

16. The combination of claim 14, the fit being a tight fit having a tolerance between about 0 and 0.003 inch.

17. The combination of claim 13, the annulus casting downstream end contoured to engage the lip along the upstream surface and at least a portion of the outboard surface of the lip.

18. The combination of claim 13, the annulus casting downstream end contoured to engage the lip along the upstream surface and at least a portion of the inboard surface of the lip.

* * * * *